US008782825B2

(12) United States Patent
Schimmelpfeng

(10) Patent No.: US 8,782,825 B2
(45) Date of Patent: Jul. 22, 2014

(54) SLIDING AND EXPANDING SOFA AND SEAT FRAME

(76) Inventor: Fausto Barbero Schimmelpfeng, Sorocaba (BR)

( * ) Notice: Subject to any disclaimer, the term of this patent is extended or adjusted under 35 U.S.C. 154(b) by 252 days.

(21) Appl. No.: 13/198,049

(22) Filed: Aug. 4, 2011

(65) Prior Publication Data

US 2013/0031721 A1 Feb. 7, 2013

(51) Int. Cl.
*A47C 17/13* (2006.01)

(52) U.S. Cl.
USPC ..... 5/48; 5/17; 5/37.1; 5/41; 5/47

(58) Field of Classification Search
USPC ..... 5/17, 18.1, 37.1, 39, 41, 47, 48; 297/118, 343, 354.13, 452.13, 452.16
See application file for complete search history.

(56) References Cited

U.S. PATENT DOCUMENTS

| | | | | |
|---|---|---|---|---|
| 2,568,366 | A * | 9/1951 | Rosen | 5/18.1 |
| 3,685,063 | A | 8/1972 | Morgan | |
| 4,031,577 | A | 6/1977 | Kanowsky et al. | |
| 4,173,045 | A | 11/1979 | Osborn | |
| 4,204,287 | A * | 5/1980 | Lane et al. | 5/18.1 |
| 4,586,206 | A * | 5/1986 | Singer | 5/18.1 |
| 7,171,706 | B2 * | 2/2007 | Piretti | 5/18.1 |
| 8,196,236 | B2 * | 6/2012 | Smythe | 5/18.1 |

* cited by examiner

*Primary Examiner* — Nicholas Polito
(74) *Attorney, Agent, or Firm* — Steven A. Nielsen; Allman & Nielsen, P.C.

(57) ABSTRACT

An extendable system for sofas and armchairs uses a moveable seat and moveable head piece to travel along a curved head piece and stationary base. Frame members of the moveable seat and stationary base use a system of rails, ruler guides, notches and other wood components to facilitate the fluid movement and safe locking of the moving and stationary components.

4 Claims, 10 Drawing Sheets

SLIDING AND EXPANDING SOFA AND SEAT FRAME

BACKGROUND OF THE INVENTION (1) Field of the Invention

The invention generally relates to extending sofa and seat systems. More particularly, the invention relates to dual layered seat systems.

(2) Description of the Related Art

U.S. Pat. No. 4,173,045 granted on Nov. 6, 1979 to Osborn discloses a series of hingedly connected cushions that fold from a sofa potion to a bed position. The Osborn sofa does not have an expanding frame, allowing for added length to a bed configuration.

U.S. Pat. No. 4,031,577 granted on Jun. 28, 1977 to Kanowsky et al discloses a convertible sofa bed using a complex maze of mechanical latch members. The Kanowsky sofa requires a lifting of frame components to convert the sofa to a bed configuration.

U.S. Pat. No. 3,685,063 granted on Aug. 22, 1972 to Morgan discloses a triangular back rest system but fails to teach any system of using a sloped back system to assist in moving components from a sofa to bed position.

BRIEF SUMMARY OF THE INVENTION

The present invention overcomes shortfalls in the related art by presenting an unobvious and unique combination, configuration and use of guide and attachment elements that have achieved unexpected results in producing a new, novel and useful sliding and expanding seat and/or sofa frame. The known related art fails to disclose, suggest or teach the use of the disclosed components to construct a lightweight, easy to assembly, efficient and cost-effective sofa bed.

Embodiments of the invention include the use of a ruler guide system that serves as a guide and stabilizing mechanism. The ruler guide system includes a channel. A dual layered frame system allows for a compact sofa or chair configuration while accommodating a relatively long bed configuration by the artful use of moving voids within frame components.

Embodiments of the invention eschew the use of metallic elements, hinges, and ratchets. An inclined backrest component assists in the fluid movement of upper components.

Embodiments of the invention include sets of supporting bars installed upon the seat components and interlocking supporting bars installed upon base components. A disclosed seat frame includes means to slide within a base bar. Bar and guide components may contain recessed components facilitating the locking of seats.

REFERENCE NUMERALS IN THE DRAWINGS

Figure 1:
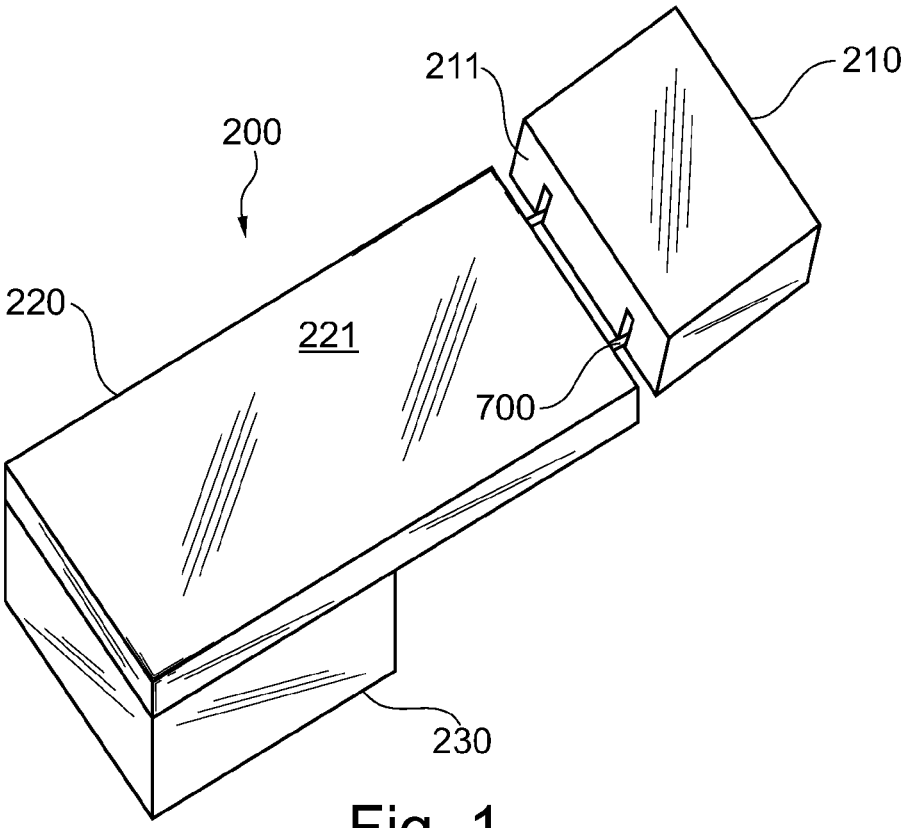
FIG. 1 is a perspective view of a moving top assembly

100 frame system of moving seat piece
101 ruler rails of moving seat piece
102 locking element of ruler rail 101
200 moving top assembly
210 moving head piece
211 inside surface of moving head piece
212 top surface of moving head piece shown in a webbing configuration
220 moving seat piece
221 top side of moving seat piece
222 bottom side of moving seat piece
223 void within bottom side of moving seat piece
224 peg upon bottom side of moving seat piece
225 top surface of moving seat piece shown in a webbing configuration
226 top edge side of moving seat piece
230 moving foot base
231 bottom side of moving foot base
232 wheels mounted within bottom side of moving foot base
240 bottom side of moving foot base
250 voids within moving foot base
300 stationary curved head piece
310 sidewall of curved head piece
320 curved section of curved head piece 300
330 rails of curved head piece 300
400 stationary base and curved head piece assembly
401 void between moving head piece and moving seat piece with the moving seat piece in full extension from the moving head piece
410 void between moving head piece and moving seat piece
411 void between stationary base and moving foot base
500 stationary base
510 stationary base rails
600 frame system or frame components of base 500
601 main rails of base
602 cross-rail attaching the two main rails 601 together
603 slope section of main rail 601
604 rest stop of main rail
605 vertical stop next to rest stop 604
606 vertical support adjacent to vertical stop 605
607 vertical support adjacent to slope section 603 of main rail
700 connection strips between moving head piece and moving seat piece These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

FIG. 1 shows a moving top assembly 200 in a narrow configuration for purposes of illustration and to show that the principles of the present disclosure may be applied to chairs and sofas and not just to sofa beds. A moving head piece 210 is shown with an inside surface 211 and with two or more connection strips 700. The connection strips 700 are shown in a state of connection and expansion when attached to a separated moving seat piece 220. In the shown embodiment a smooth top surface 221 is shown upon the moving seat piece. A moving foot base is shown in connection with the moving seat piece.

Figure 2:
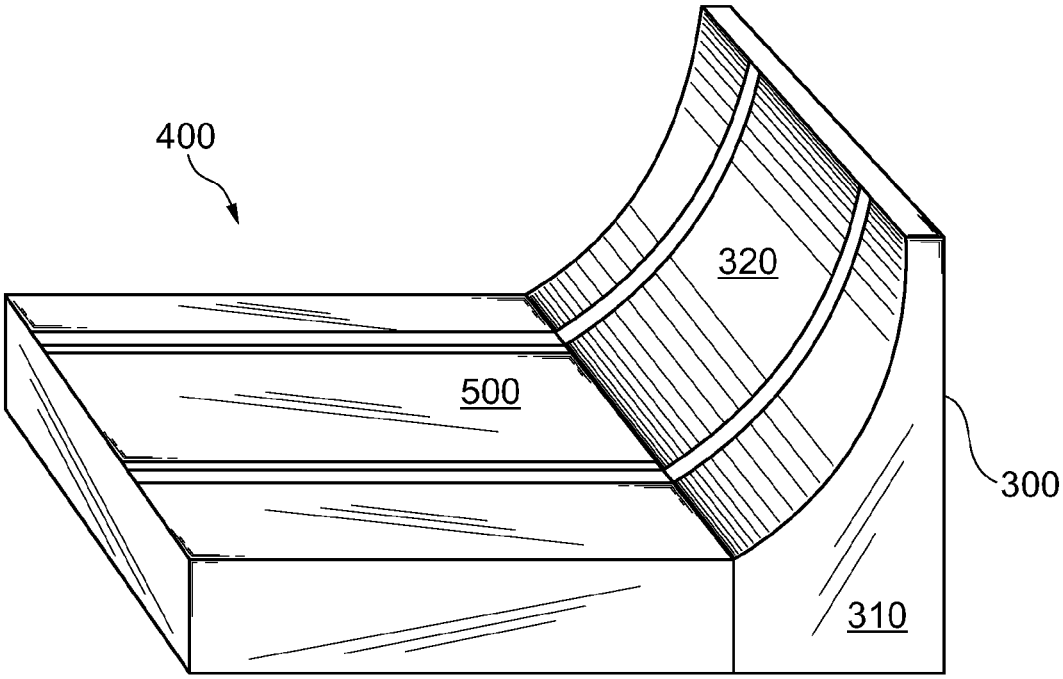
FIG. 2 is a perspective view of a stationary base and curved head piece assembly

FIG. 2 presents an embodiment of a stationary base and curved head piece assembly 400. A stationary curved head piece 300 comprises a sidewall 310 with certain sections of the sidewall being congruent with a curved section 320 of the curved head piece. The curved section 320 of the curved head piece facilitates the easy movement of the moving head piece 210. A stationary base is shown in an optional box form and is shown attached to the stationary curved head piece 300.

Figure 3:
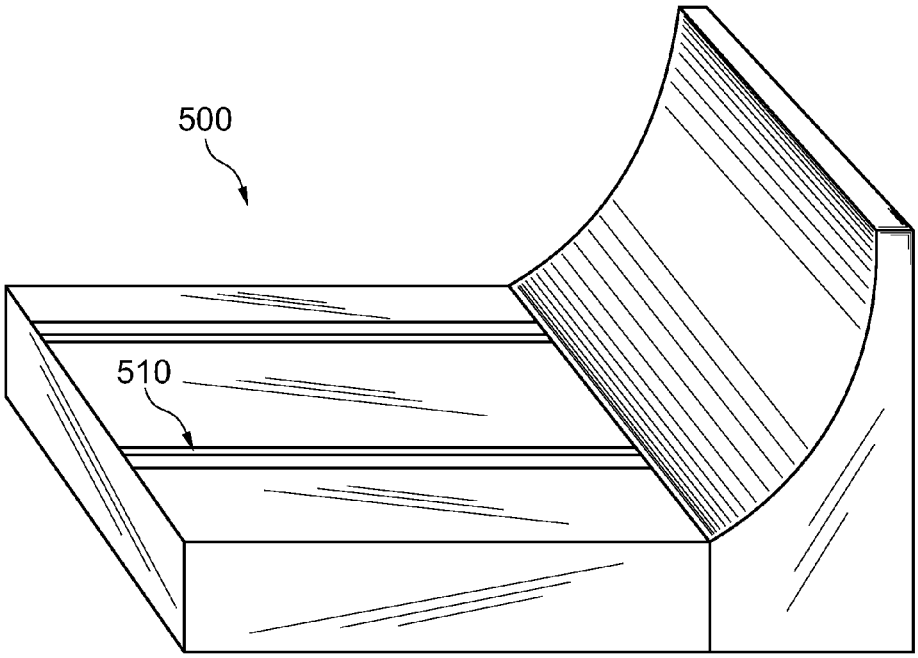
FIG. 3 is a perspective view of a stationary base with stationary base rails

FIG. 3 shows a stationary base 500 with optional stationary base rails 510.

Figure 4:
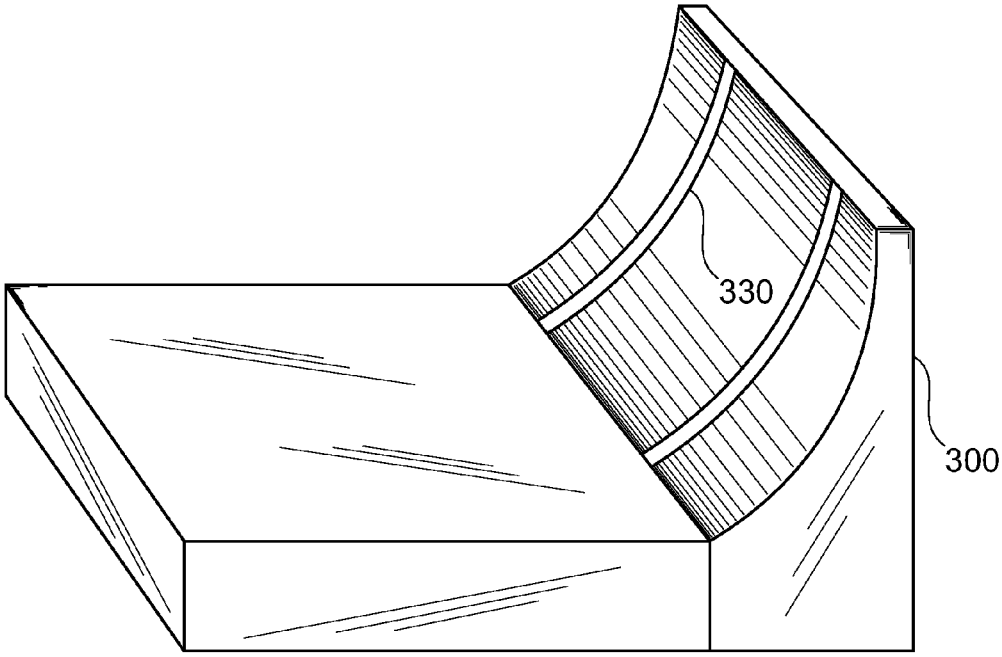
FIG. 4 is a perspective view of a curved head piece with rails

FIG. 4 shows a stationary curved head piece 300 with optional rails 330.

Figure 5:
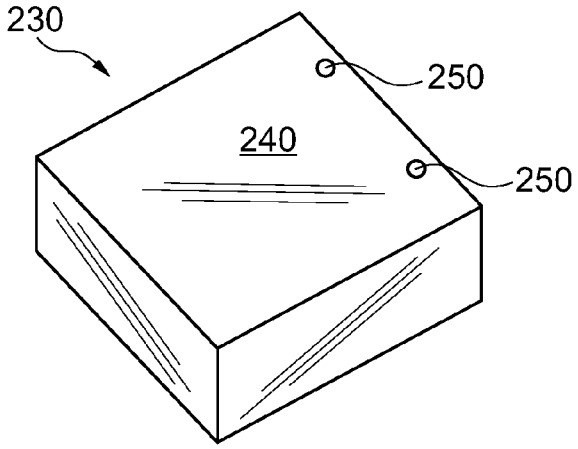
FIG. 5 is a perspective view of the bottom side of a moving foot base

FIG. 5 shows a bottom side 240 of a moving foot base 230. Optional peg voids 250 are shown. In one disclosed embodiment, pegs and peg voids are used to secure components.

Figure 6:
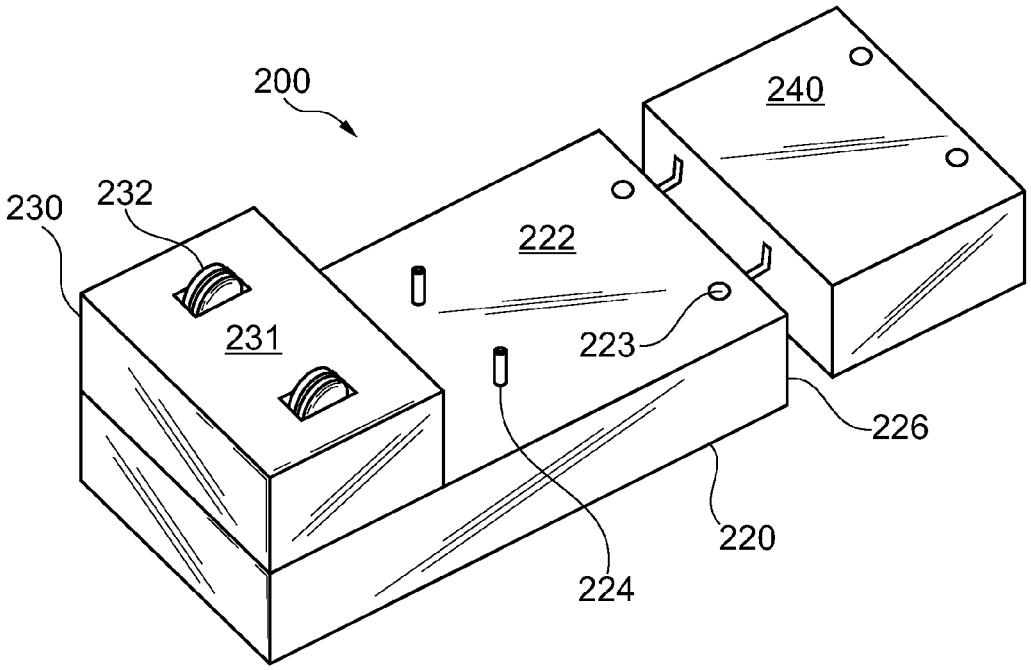
FIG. 6 is a perspective bottom view of a moving top assembly

FIG. 6 shows a moving top assembly 200 in an upside down position. A moving foot base 230 is shown with optional wheels 232 mounted within a bottom side 231 of a moving foot base. A moving seat piece 220 is shown with pegs 224 and voids 223.

Figure 7:
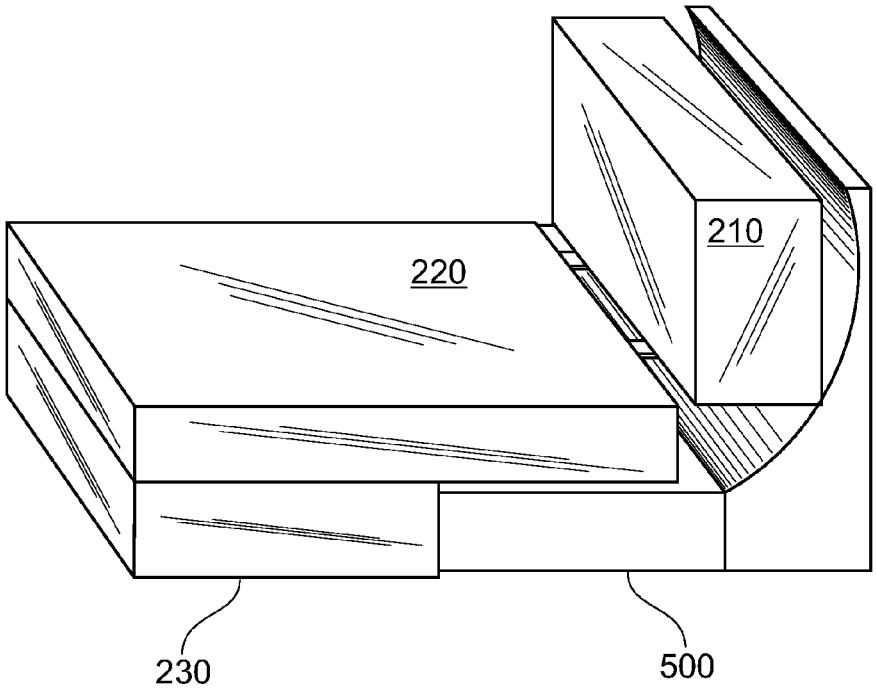
FIG. 7 is a top perspective view of one embodiment of the invention

FIG. 7 presents an embodiment in an up or compact position wherein a moving head piece 210 is in a vertical position and wherein the stationary base 500 is adjacent to the moving foot base 230.

Figure 8:
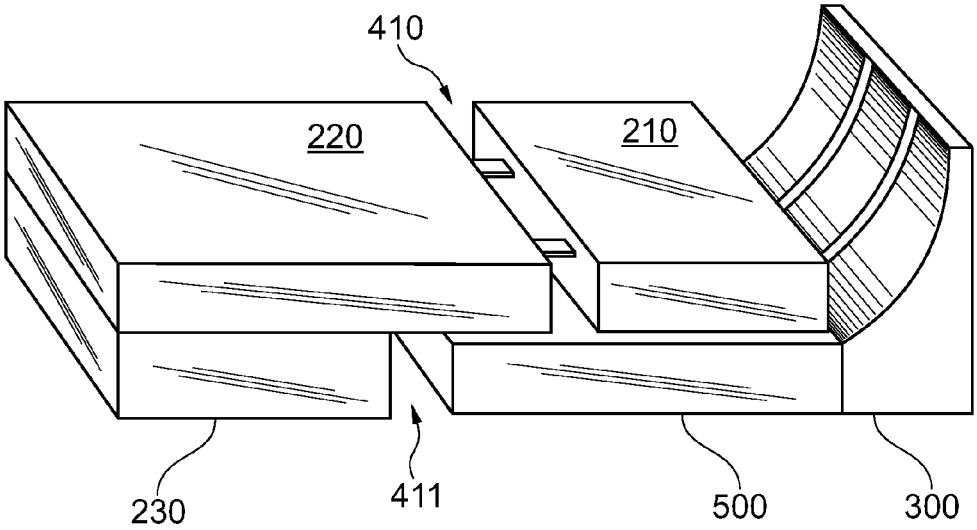
FIG. 8 is a top perspective view of moving top assembly in a lowered and spread apart position.

FIG. 8 presents an embodiment in a folded or expanded position wherein there is a void 410 between the moving head piece 210 and the moving seat piece 220. In this expanded position there is a void 411 between the stationary base 500 and the moving foot base 230.

Figure 9:
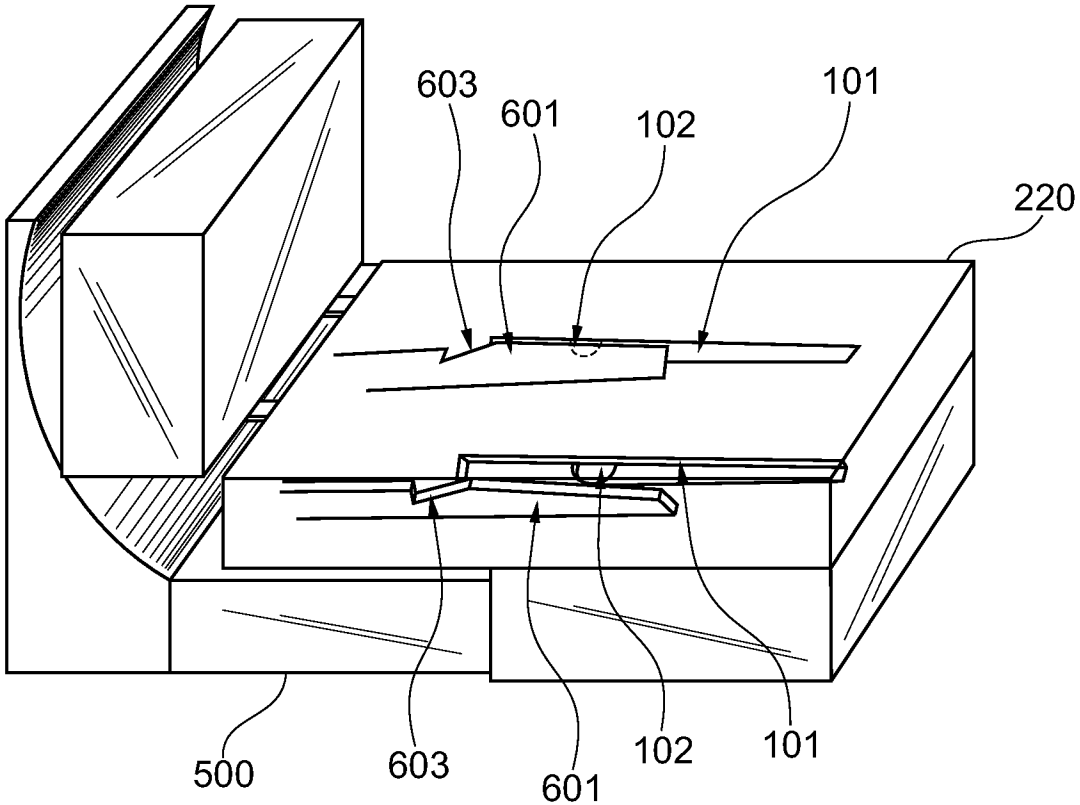
FIG. 9 is a cut away view of rail components
Figure 11:
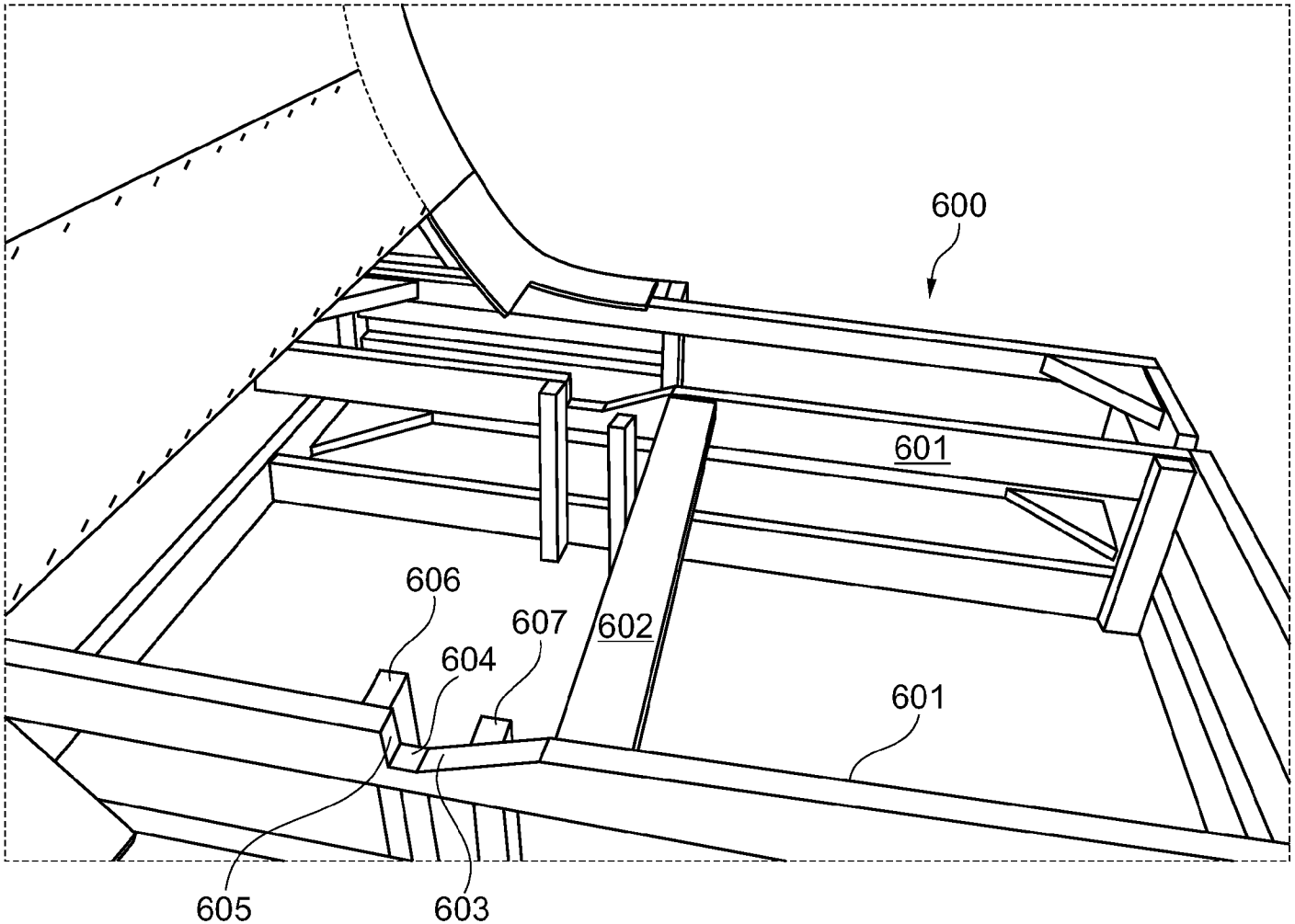
FIG. 11 presents a perspective view of frame members of one embodiment of the invention

FIG. 9 presents an alternative embodiment with a stationary base 500 having two or more main rails 601 with each main rail having slope section 603 and other details shown in FIG. 11. The moving seat piece 220 is shown with two or more ruler rails 101 with each ruler rail having a locking element 102.

Figure 10A:
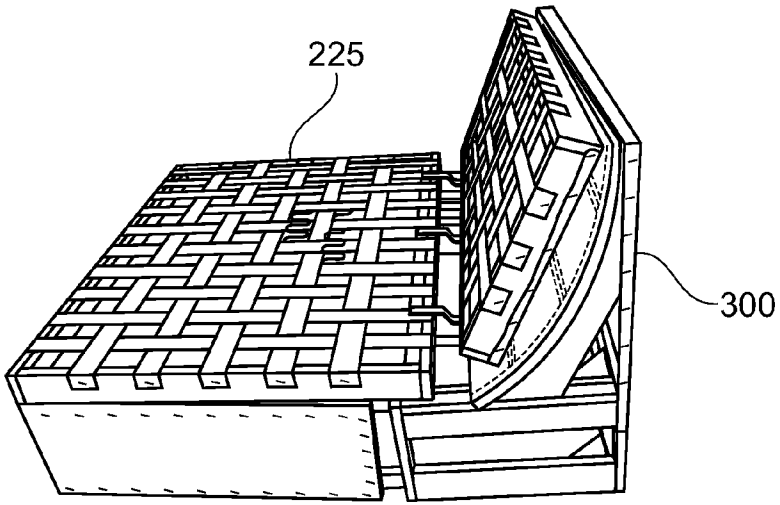
FIG. 10 A-C present perspective views of one embodiment of the invention in different states
Figure 10C:
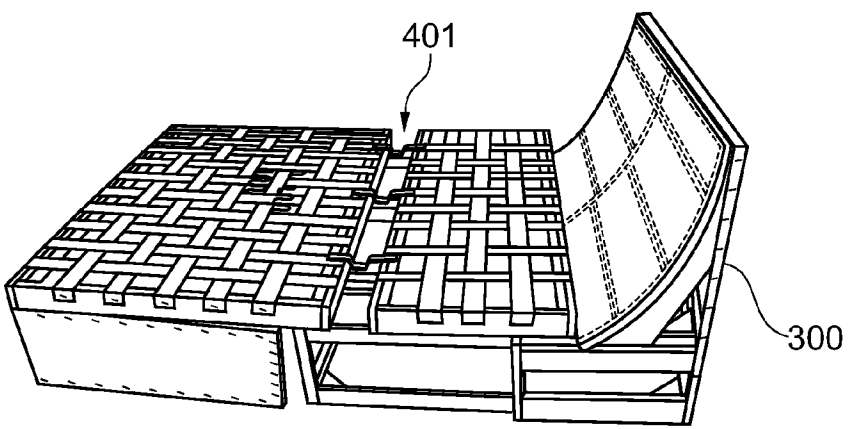
Figure 10B:
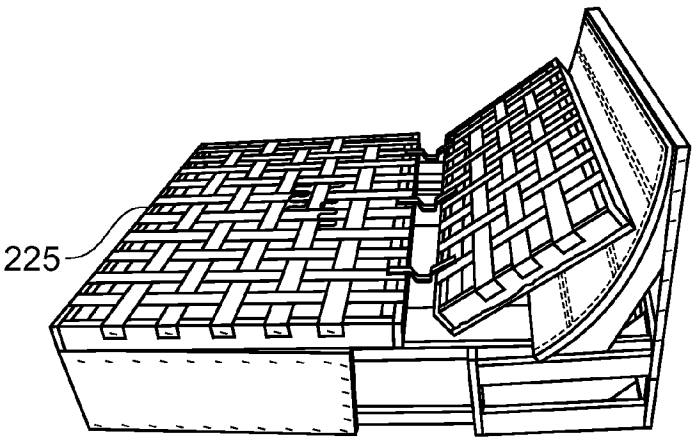

FIG. 10 A shows an alternative embodiment of web covering 225 upon a moving seat piece and a similar webbing treatment to a moving head piece.

FIG. 10 B shows a moving head piece transitioning down a stationary curved head piece 300.

FIG. 10 C shows a full extension between a moving head piece and a moving seat piece and a resulting void 401 between the two.

FIG. 11 presents an expanded view of a frame system 600 of a stationary base and having one or two main rails 601, with the main rails connected with a cross-rail 602. The main rails comprise a slope section 603 being adjacent to a flat rest stop 604, with a bottom surface of the rest stop being adjacent and perpendicular to a vertical stop. A vertical support 606 is shown to be attached to and adjacent to the vertical stop 605. A vertical support 607 is adjacent and attached to the slope section 603. The slope section 603 and related components are sometimes used to secure components of a moving head piece and or moving seat piece.

Figure 12:
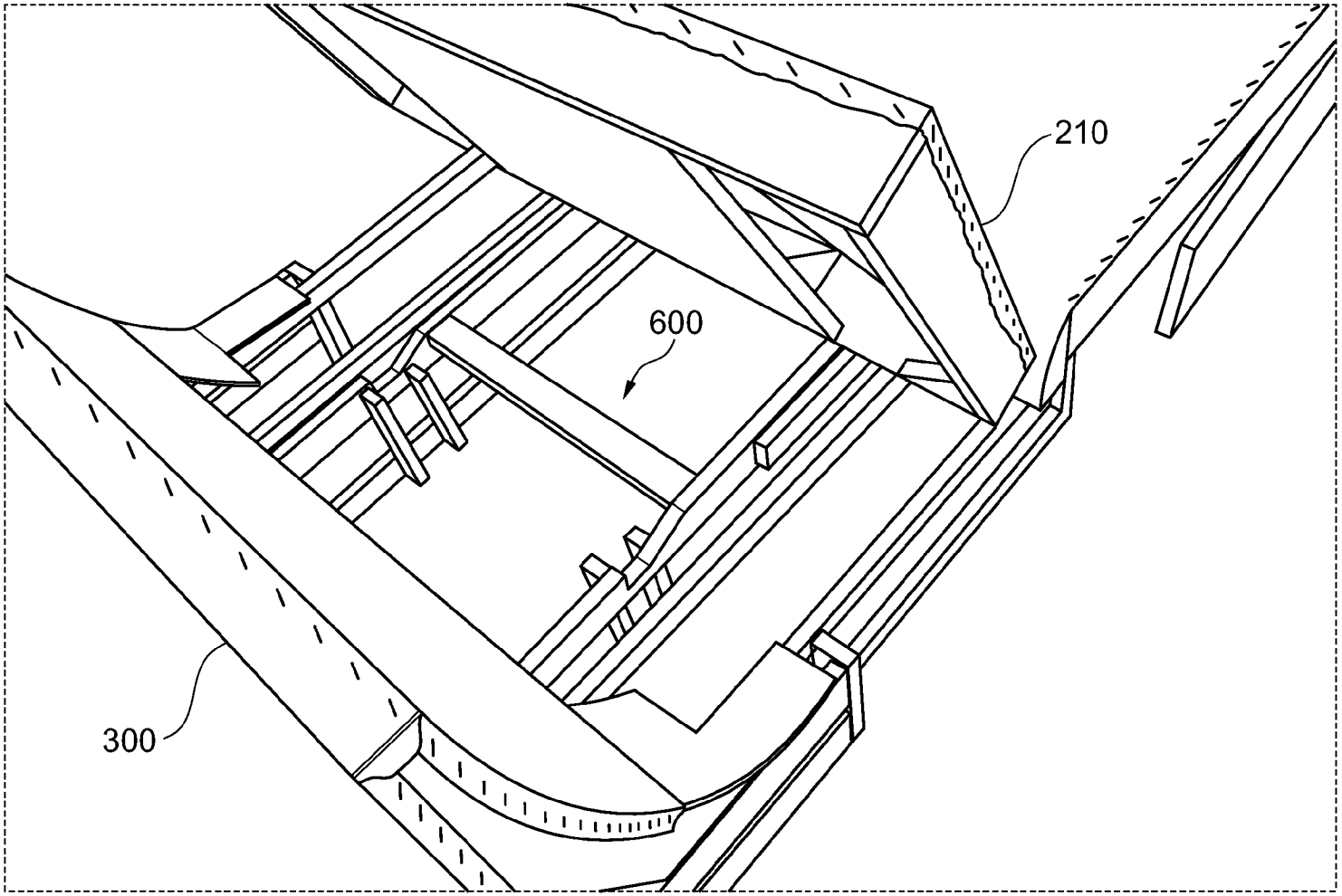
FIG. 12 presents a perspective view of frame members of one embodiment of the invention

FIG. 12 shows a top perspective view of frame members 600 of a stationary base. A stationary curved head piece 300 is shown with a lifted moving seat piece 210.

Figure 13:
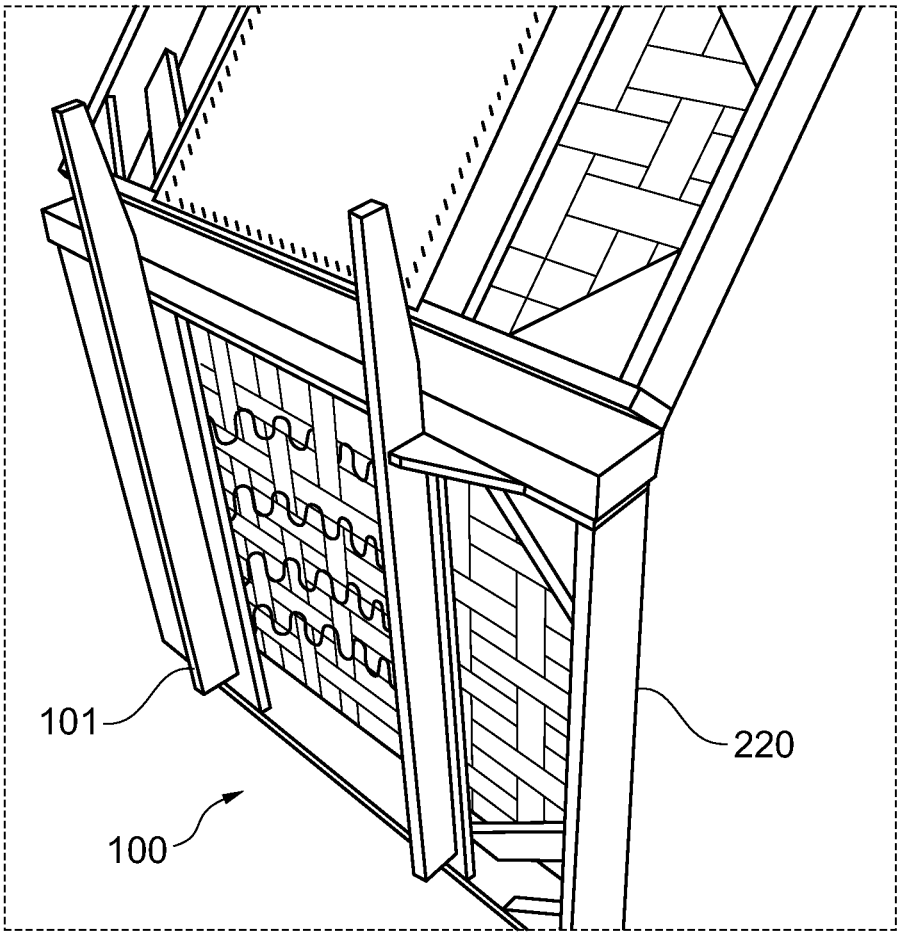
FIG. 13 presents a perspective view of frame members of one embodiment of the invention

FIG. 13 presents a frame system 100 of a moving seat piece with ruler rails 101 attached to the moving seat 220.

Figure 14:
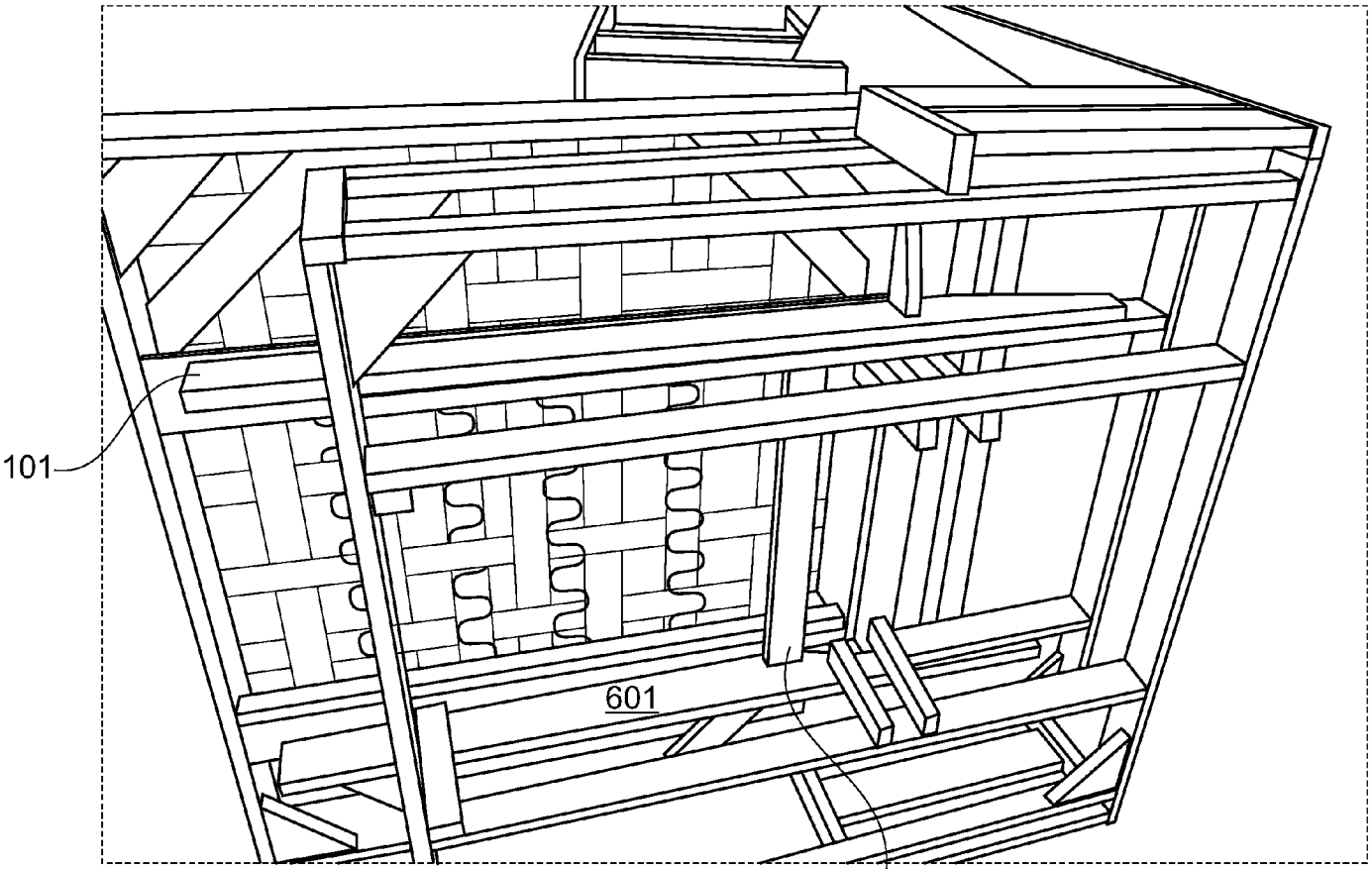
FIG. 14 presents a perspective view of frame members of one embodiment of the invention

FIG. 14 presents an underside perspective view of frame assemblies for both a moving seat piece and a stationary seat piece. A ruler rail 101 is shown to be in interaction with a main rail of a base.

Embodiments of the invention may comprise sets of supporting bars and alignment of two or more bars fixed on a moving seat, noiseless coated material, which serves to stabilize and align the seat in another set of bars placed at the base, replacing the metal strip from the base of the backrest, by synthetic tape to slide together. The second set of bars at the base is coated with anti-friction plastic material. The bars of the base has a recess at its end for locking the seat in the closed position. The seat frame is provided with a component that slides in the base bar on bar coated with anti-friction plastic material, which may become lodged in the recess of the end, promotes the locking seat.

Embodiments of the invention may eliminate mechanical components, especially those made of metal. The use of metal is replaced by a structure that may comprise solely wood components and use of anti-friction coatings for noiseless operation.

The disclosure herein, eschews the complex prior art systems using sets of extender metal turnstiles for positions of tilt and for the transformation of the seat backrest. The present disclosure includes replacing mechanical systems with two sets of guide strips of wood, simplifying the tasks of stretching, setting and locking the assembly and eliminating the risk of corrosion of metal parts. The replacement of synthetic metal tape with other types of tape prevents corrosion and cutting problems sometimes found with metal tape.

The disclosure includes the innovative use of a tab on the back of the base, transforms into the back seat without any mechanism, facilitating the opening and closing of the sofa, with a significant reduction in costs and manufacturing time.

The disclosure a novel extension system that may include a guide pin that locks the seat base, but allows it to slide. One embodiment of a disclosed system may be described as an extendable system for sofas and armchairs with simultaneous use of the seat and back, in which the seat slides down a sloping base, the seat resting on a flat base and a support at the end of the seat with wheels on the other end of the seat (the front of the seat). The seat is fixed to the base with a channel with a locating pin that does not allow the seat to drop, and a metal rail to slide the seat. Connected to the seat, the backrest tilted down in a meeting with the base flat base, supported by a slide rail, thus transforming the back seat in continuity allowing greater area of use when fully extended.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

Items

Embodiments of the invention include, but are not limited to the following items, the terms of which are not controlling in defining terms within the claims. Terms and reference numbers within this item section may provide one or more definitions of terms, but the terms of the claims are not bound or limited by this item section.

Item 1. A sofa system, the system comprising:

a) a moving head piece 210, having six sides, the sides including a top surface 210 and an inner surface 211 with the inner surface being attached to two or more connection strips 700 and with the connection strips 700 connected to;

b) a moving seat piece 220, the moving seat piece having six sides with an top edge side 226 attached to the connection strips 700 and with the moving seat piece having a bottom side 222 having two or more voids and two or more pegs 224 and the moving seat piece being connected to;

c) a moving foot base 230 having six sides with a bottom side 231 containing two or more wheels 232 partially contained within voids of the moving foot base;

d) a stationary curved head piece 300 comprising a sidewall 310 with the sidewall comporting to a perpendicular curved section 230 of the curved head piece 300 and the stationary curved head piece connected to;

e) a stationary base 500;

f) wherein the moving foot base 230, moving seat piece 220 and moving head piece travel along the stationary base 500 and stationary curved head piece 300 such that the moving head piece is in a vertical position when the moving foot base is placed adjacent to the stationary base and wherein; and g) the moving head piece 210 is in a horizontal position when the moving foot base 230 is moved away from the stationary base 500 such that a void 410 is created between the moving head piece and the moving seat piece.

Item 2. The sofa system of item 1 wherein the moving head piece 210 is in a horizontal position when a first void 410 is created between the moving head piece and the moving seat piece and wherein a second void is created between the stationary base 500 and moving foot base 230.

Item 3. The sofa system of item 1 wherein the moving seat comprises frame components 100 comprising two or more 101 ruler rails;

a) the stationary base 500 comprises frame components 600 comprising;

b) one or more main rails 601 with a cross-rail 602 attaching the main rails; and c) each main rail 601 having a slope section 603 with the slope section adjoining a flat rest stop 604 and with the flat rest stop adjoining and being perpendicular to a vertical stop 605.

Item 4. The sofa system of item 3 wherein the ruler rails 101 comprise locking elements suitable for lodging into the slope section 603 and rest stop 604 section of a main rail 601.

What is claimed is:

1. A sofa system, the system comprising:

a) a moving head piece, having six sides, the sides including a top surface and an inner surface with the inner surface attached to two or more connection strips and with the connection strips connected to;

b) a moving seat piece, the moving seat piece having six sides with a top edge side attached to the connection strips and with the moving seat piece having a bottom side having two or more voids and two or more pegs and the moving seat piece being connected to;

c) a moving foot base having six sides with a bottom side containing two or more wheels partially contained within voids of the moving foot base;

d) a stationary curved head piece comprising a sidewall with the sidewall comporting to a perpendicular curved section of the curved head piece and the stationary curved head piece connected to;

e) a stationary base;

f) wherein the moving foot base, moving seat piece and moving head piece travel along the stationary base and stationary curved head piece such that the moving head piece is in a vertical position when the moving foot base is placed adjacent to the stationary base; and wherein g) the moving head piece is in a horizontal position when the moving foot base is moved away from the stationary base such that a void is created between the moving head piece and the moving seat piece.

2. The sofa system of claim 1 wherein the moving head piece is in a horizontal position when a first void is created between the moving head piece and the moving seat piece and wherein a second void is created between the stationary base and moving foot base.

3. The sofa system of claim 1 wherein the moving seat comprises frame components comprising two or more ruler rails;

a) the stationary base comprises frame components comprising;

b) one or more main rails with a cross-rail attaching the main rails; and c) each main rail having a slope section with the slope section adjoining a flat rest stop and with the flat rest stop adjoining and being perpendicular to a vertical stop.

4. The sofa system of claim 3 wherein the ruler rails comprise locking elements suitable for lodging into the slope section and rest stop section of a main rail.

* * * * *